US006503010B2

(12) United States Patent
Jeong

(10) Patent No.: US 6,503,010 B2
(45) Date of Patent: Jan. 7, 2003

(54) PAPER PICKUP APPARATUS FOR A PRINTER

(75) Inventor: Seung-Sik Jeong, Seoul (KR)

(73) Assignee: Samsung Electronics Co., Ltd., Suwon (KR)

( * ) Notice: Subject to any disclaimer, the term of this patent is extended or adjusted under 35 U.S.C. 154(b) by 86 days.

(21) Appl. No.: 09/795,350

(22) Filed: Mar. 1, 2001

(65) Prior Publication Data

US 2001/0051067 A1 Dec. 13, 2001

(30) Foreign Application Priority Data

May 31, 2000 (KR) ..... 00-29596

(51) Int. Cl.[7] ..... B41J 13/10; B41J 13/08; B41F 13/24; B65H 3/06

(52) U.S. Cl. ..... 400/629; 400/634; 400/638; 101/232; 271/109; 271/113

(58) Field of Search ..... 400/629, 617, 400/624, 636.2, 634, 638; 271/9, 140, 162, 4.08, 109, 113; 101/232

(56) References Cited

U.S. PATENT DOCUMENTS 4,789,259 A * 12/1988 Katayanagi ..... 400/624
4,822,019 A * 4/1989 Nagira ..... 271/9
4,930,916 A * 6/1990 Fujiwara ..... 400/636
6,029,970 A * 2/2000 Hwang ..... 271/9.08

* cited by examiner

*Primary Examiner*—Andrew H. Hirshfeld
*Assistant Examiner*—Marvin P. Crenshaw
(74) *Attorney, Agent, or Firm*—Robert E. Bushnell, Esq.

(57) ABSTRACT

A paper pickup apparatus in a printer for pivotally moving by a motor includes a driving shaft rotated by the motor, a first pickup housing having at least one first transmission gear and first and second end portions, the first end portion mounted to the driving shaft, the first transmission gear transmitting torque from the driving shaft, a second pickup housing having at least one second transmission gear and being rotatably mounted to the second end portion of the first pickup housing, the second transmission gear transmitting torque from the first pickup housing, a connecting portion for connecting the first and second pickup housing with each other, the first pickup housing being rotatable to the second pickup housing centering thereon, and a pickup roller mounted to the second pickup housing and rotated by torque from the second transmission gear.

20 Claims, 5 Drawing Sheets

PAPER PICKUP APPARATUS FOR A PRINTER

CLAIM OF PRIORITY

This application makes reference to, incorporates the same herein, and claims all benefits under 35 U.S.C. § 119 from an application entitled Paper Pickup Apparatus for a printer earlier filed in the Korean Industrial Property Office, on 31 th day of May 2000, and there duly assigned Ser. No. 2000-29596, a copy of which is annexed hereto.

BACKGROUND OF THE INVENTION

1. Field of the Invention

The present invention relates to a paper pickup apparatus for a printer, and more particularly, to a paper pickup apparatus for a printer for picking up print sheets one by one from a stack on a cassette.

2. Description of Related Art

A printer for printing text and graphic images on print media such as print sheets includes a cassette on which the print sheets are stacked, a print sheet feed device for feeding a print sheet into a printing portion of the printer where a printing operation is performed, a pickup apparatus for picking up a print sheet from a stack on the cassette and transferring the print sheet to the print sheet feed device. A conventional pickup apparatus disposed adjacent to the cassette on which the print sheets are stacked includes a pickup roller for picking up print sheets one by one from the stack on the cassette and a drive motor for driving the pickup roller. The paper pickup apparatus should pick up one print sheet at a time from the stack of the cassette. In order to pick up one print sheet at a time from the cassette, the pickup roller is press-contacted with the stack by applying a predetermined press-contact force against a print sheet and then is rotated. If a press-contact force against a print sheet is very high, a plurality of print sheets may be picked up at once. On the other hand, if a press-contact force against a print sheet is very low, even one print sheet may not be picked up.

As an example to effectively pick up paper sheets one by one from the cassette, an additional plate is arranged between a bottom surface of the cassette and the stack of print sheets, and a spring is disposed between the plate and the bottom surface of the cassette, whereby the plate has an elastic force while the spring is biased to push the plate against the stack of the print sheets. As another example, a pickup roller press-contacts the stack and picks up a print sheet by pivotally moving a paper pickup apparatus using a motor toward the stack. Since a direction in which a pickup roller picks up a print sheet is opposite to a pivoting direction of the paper pickup apparatus, as the number of the print sheet stacked in the cassette varies, or as a thickness of print sheets stacked in the cassette varies, a repulsive force against a pivoting direction of the paper pickup apparatus varies and becomes greater. Due to such a repulsive force, a motor becomes overloaded, whereby durability of the motor may be reduced.

In efforts to overcome the problems described above, Optra S1650 model available from Lexmark International Inc. includes a high-capacity motor. However, as capacity of the motor becomes increased, a production cost of the motor and the printer becomes higher, and electric power is consumed more as well. U.S. Pat. No. 5,377,969 for Method and Device for Separating Sheet-Type Recording Media issued to Steinhilber discloses a paper pickup apparatus disposed to move toward direction in which a repulsive force occurs against the paper pickup apparatus. However, very complicated configurations are required to the mechanism of the paper pickup apparatus so as to move the pickup apparatus itself within the printer.

For the foregoing reasons, there is a need for a paper pickup apparatus of a printer capable of effectively picking up one paper sheet at a time from a cassette by reducing a repulsive force exerted to the paper pickup apparatus and occurred against a pivoting direction thereof.

SUMMARY OF THE INVENTION

It is an object of the present invention to provide a method and an apparatus for reducing a production cost of a paper pick-up apparatus in a printer.

It is another object to provide a method and an apparatus able to increase durability of a motor used in a paper pickup apparatus in a printer.

It is still object to provide a method and an apparatus capable of maintaining an elastic force exerted on a stack of a cassette in a printer.

It is yet another object to provide a paper pickup apparatus in a printer able to reduce a repulsive force against a pivoting direction thereof due to portion of the paper pickup apparatus rotating toward on opposite direction to the pivoting direction.

It is further object to provide a paper pickup apparatus in a printer able to prevent an overload of a motor rotating a pickup roller of the paper pickup apparatus.

It is also object to provide a method and an apparatus able to provide more space for print sheets stacked in a cassette and reduce a paper pickup apparatus and a cassette in size.

These and other objects may be achieved by using a printer to provide a paper pickup apparatus having a motor for rotating a pickup roller of a pickup roller unit and providing torque to the picup roller unit, a driving shaft rotated by the motor, a first pickup housing having at least one first transmission gear and first and second end portions, the first end portion mounted to the driving shaft, the first transmsion gear transmitting torque from the driving shaft to the second end portion, a second pickup housing having at least one second transmitting gear and rotatably mounted to the second end portion of the first pickup housing, the second transmission gear transmitting torque from the first pickup housing to the second pickup housing, a connecting portion connected between the first and second pickup housings, the first pickup housing rotatably connected to the second pickup housing centering thereon, and a pickup roller mounted to the second pickup housing and rotated by torque transmitted from the second transmission gear.

The connecting portion includes an elastic member for providing the second pickup housing unit with an elastic force toward an opposite direction to a direction that the second pickup housing rotates by a repulsive force about the first pickup housing. The elastic member is a torsion spring having first and second end portions and a central portion formed between the first and second end portions. The first end portion of the torsion is supported by the first pickup housing while the second end portion of the torsion is supported by the second pickup housing, and the central portion of the torsion is inserted around a connection shaft protruding from the second pickup housing. The first pickup housing has a first protruding portion located at a location corresponding to the first end portion of the torsion spring, and the second pickup housing has a second protruding portion located at a location corresponding to the second end portion of the torsion spring. The first pickup housing further include a limiting shaft protruding from the first pickup housing, and the second pickup housing further includes a third protruding portion extending in a longitudinal direction to contact the limiting shaft, whereby a movement that the second pickup housing rotates in the direction is limited while a reverse movement that the second pickup housing rotates the opposite direction is allowed.

BRIEF DESCRIPTION OF THE DRAWINGS

A more complete understanding of the present invention and many of the attendant advantage thereof, will be readily apparent as the same becomes better understood by reference to the following detailed description when considered in conjunction with the accompanying drawings in which like reference symbols indicate the same or similar components, wherein.

DETAILED DESCRIPTION OF PREFERRED EMBODIMENTS

Figure 1:
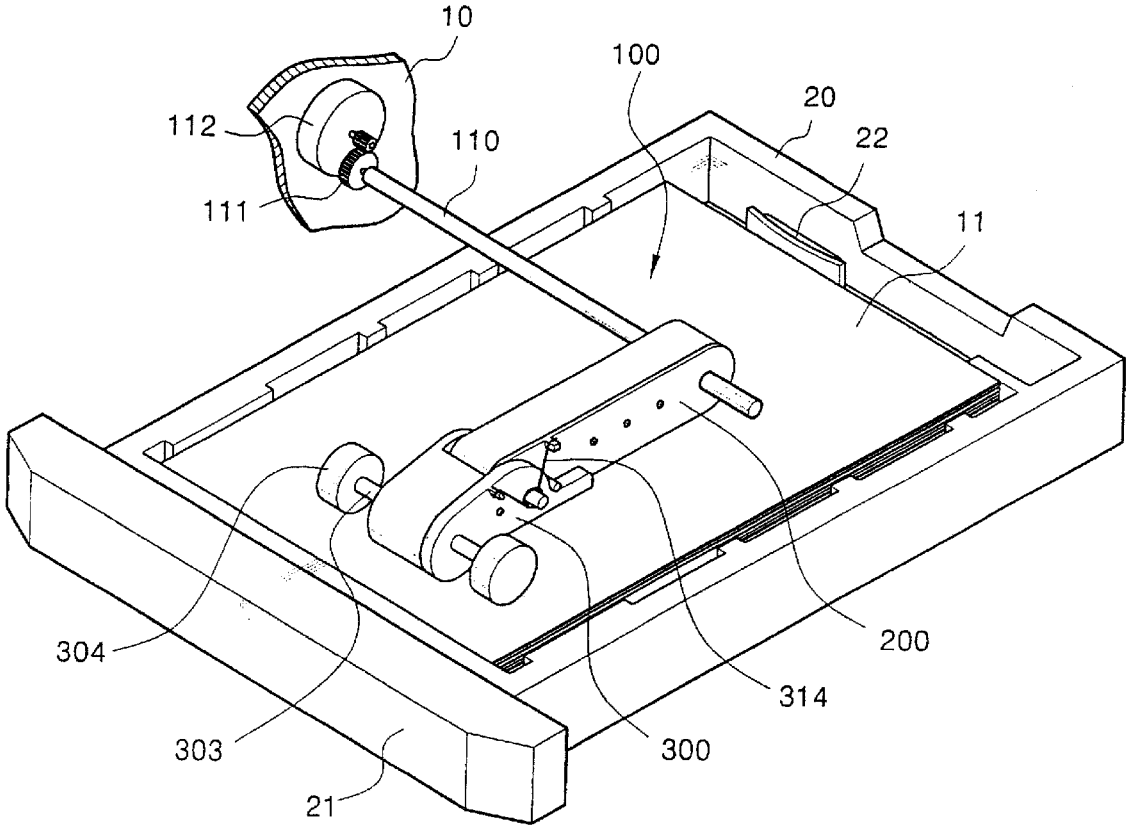
FIG. 1 is a perspective view illustrating a paper pickup apparatus mounted over a paper cassette according to the present invention.

Returning now to the drawings, FIG. 1 shows a paper pickup apparatus 100 mounted in a printer body 10 and disposed over paper cassette 20 on which print sheets 11 are stacked. Paper cassette 20 has a box-like shape having a top portion opened. A handle 21 is formed on a front side of cassette 20. A paper support 22 disposed between print sheets 11 and a wall of cassette 20 supports a stack of print sheets 11 by regulating a position of print sheet 11 according to a size of print sheet 11 placed on a bottom of cassette 20.

Paper pickup apparatus 100 includes first and second pickup housings 200 and 300. The first pickup housing 200 of paper pickup apparatus 100 is mounted to a driving shaft 110, and the second pickup housing 300 is mounted to a paper pickup roller 304 and rotatably connected to first pickup housing 200. One end of driving shaft 110 is inserted into and passes through first pickup housing 200 and extends to an inner surface of the printer body 10. The other end of driving shaft 110 opposite to first pickup housing 200 is coupled to a reduction gear 111 and a clutch. Reduction gear 111 is engaged with a motor 112 which is arranged in printer body 10. Therefore, driving shaft 110 transmits a torque of motor 112 to the paper pickup apparatus 100.

Figure 2:
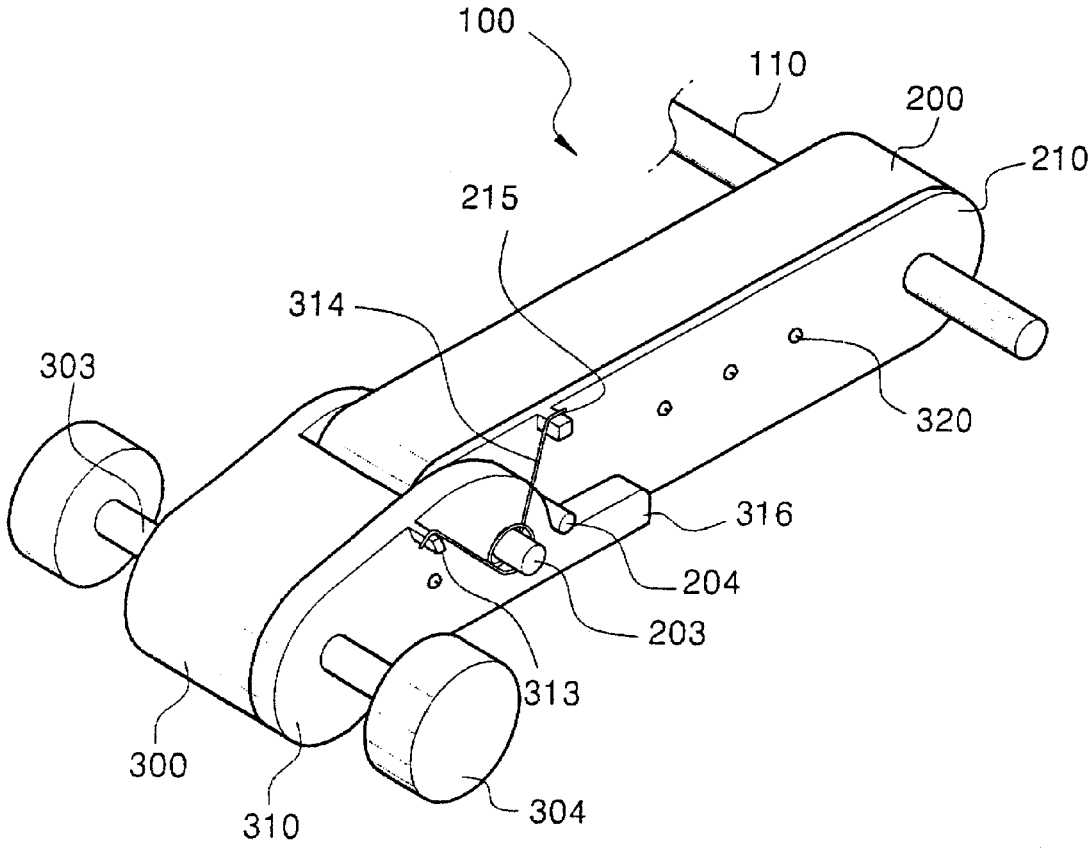
FIG. 2 is an enlarged perspective view illustrating the paper pickup apparatus of FIG. 1.
Figure 3:
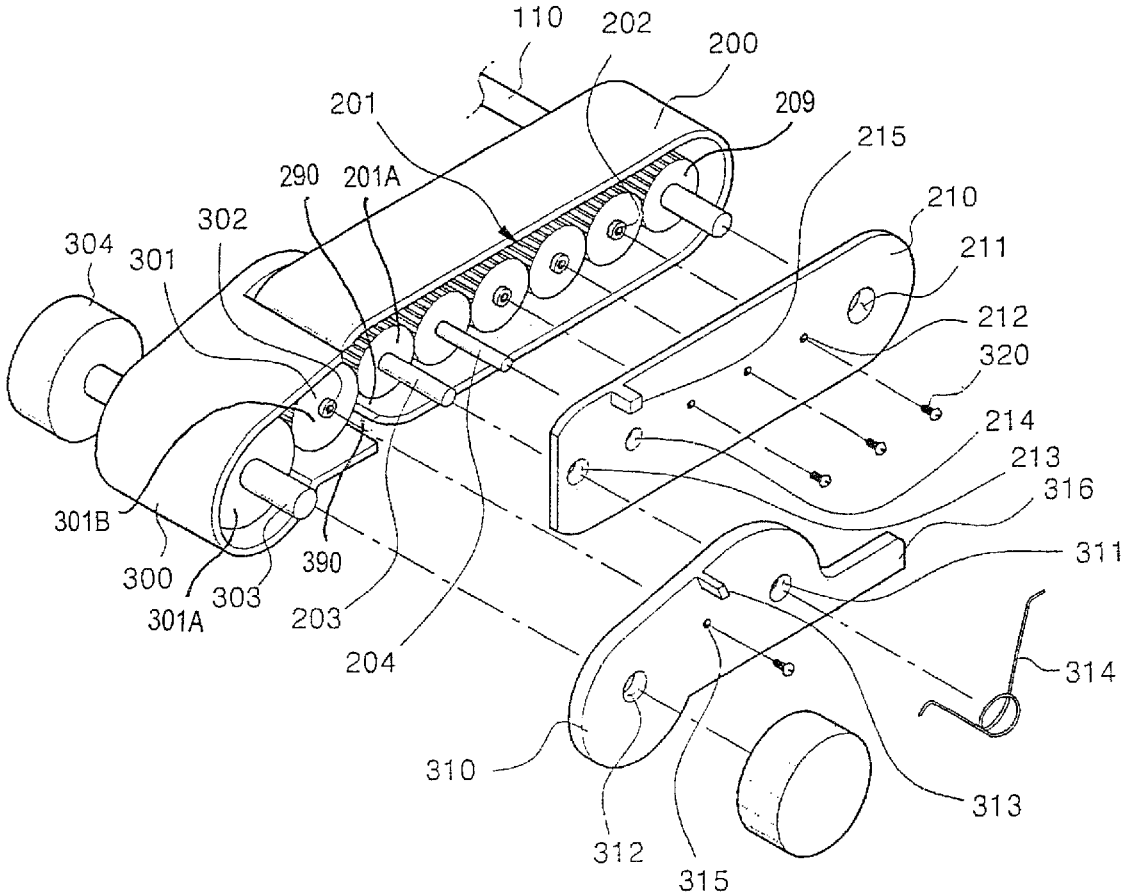
FIG. 3 is a partially exploded perspective view illustrating the paper pick-up apparatus of FIG. 1.

Referring to FIGS. 2 and 3, one end portion of first pickup housing 200 is mounted to driving shaft 110, and the other end portion of first pickup housing 200 is mounted to the second pickup housing 300rotating about first pickup housing 200.

First pickup housing 200 has a hexahedral-shape with a rectangular cross-section, and the other end portion of first pickup housing 200 adjacent to second pickup housing 300 has a first opening portion. A first pickup housing cover 210 is detachably attached to a side of first pickup housing 200 by a plurality of screws 320. A plurality of first transmission gears 201 are arranged within first pickup housing 200, and adjacent first transmission gears 201 are engaged with each other. Although six first transmission gears 201 are shown in FIG. 3, the number of and the size of first transmission gears 201 may vary depending on the size of paper pickup apparatus 100.

A first gear 209 of the first transmission gear 201 as a driving gear is mounted to driving shaft 110, and second, third, and fourth gears are engaged with each other and are rotatably supported by first support shafts 202 coupled to first pickup housing cover 210. One end portion of first support shaft 202 has a screw hole so that the first pickup housing cover 210 is coupled to first support shaft 202 and first pickup housing 200 by screws 320.

A limiting shaft 204 fitting into the fifth gear of first transmission gears 201 protrudes from pickup housing cover 210 through a second through hole 214. Shaft 204 serves to limit second pickup housing 300 rotating about first pickup housing 200 in only one direction together with a third protruding portion 316 of second pickup housing 300. A connecting shaft 203 fits into a sixth gear 201A of first transmission gears 201 adjacent to an opening portion 290 of first pickup housing 200 and protrudes from pickup housing cover 210 through a first through hole 213. Second pickup housing 300 is prevented from rotating below a line passing both limiting shaft 204 and connecting shaft 203 by the contact between third protruding portion 316 and limiting shaft 204.

First pickup housing cover 210 preferably has a plate shape, first shaft hole 211 through which driving shaft 110 passes, and screw holes 212 for a connection between first pickup housing 200 and the first pickup housing cover 210 by coupling screws 320 into first support shaft 202 through screw holes 212. First pickup housing cover 210 further includes first and second through holes 213 and 214, respectively, located at a location corresponding to connecting shaft 203 and limiting shaft 204. A first protruding portion 215 is formed at a location adjacent to second through hole 214 and extends outwardly from an outer surface of first pickup housing cover 210.

The second pickup housing 300 has a second opening portion 390 corresponding to the is first opening portion 290 of first pickup housing 200. Two second transmission gears 301 are arranged within second pickup housing 300. A first gear 301A of the second transmission gears 301 as a pickup gear is fitted by a pickup shaft 303 on which pickup roller 304 is mounted while second gear 301B of second transmission gears 301 as an intermediate gear adjacent to first pickup housing 200 is engaged with both the first gear 301A and the sixth gear 201A of first transmission gears 201 and is rotatably supported by a second support shaft 302 of which one end portion has a screw hole. Second pickup housing 300 further includes a second pickup housing cover 310 having a second shaft hole 311 and a third through hole 312. The second shaft hole 311 is located at a location corresponding to connecting shaft 203 so that connecting shaft 203 may be inserted through both first through hole 213 and second shaft hole 311. As a result, second pickup housing 300 becomes rotatable about first pickup housing 200. The third through hole 312 is located at a location corresponding to pickup shaft 303 so that pickup shaft 303 may pass through third through hole 312. Second pickup housing cover 310 further includes a screw through hole 315 located at a location corresponding to the screw hole of second support shaft 302 so that second pickup housing cover 310 is screw-coupled to second pickup housing 300 and second gear 301B is supported by second housing cover 310. A second protruding portion 313 is formed at a location adjacent to the screw hole 315 and extends outwardly to be perpendicular to an outer surface of second pickup housing cover 310. A third protruding portion 316 extends along a side of first pickup housing cover 210 in a longitudinal direction parallel to the second pickup housing cover 310. When second pickup housing 300 rotates about connecting shaft 203 and moves downward for the pickup roller 304 to pickup a print paper, third protruding portion 316 of second pickup housing 300 moves upward and contacts limiting shaft 204, whereby a rotational movement of second pickup housing 300 is limited.

An elastic member is arranged between first and second pickup housings 200 and 300 to reduce a repulsive force against a pivot movement of the paper pickup apparatus 100 by a motor 112. A middle portion of the elastic member is coiled several times to have an elastic force so that the coiled middle portion of the elastic member is fitted by connecting shaft 203. Both end portions extended from the coiled middle portion of the elastic member are respectively supported by first and second protruding portions 215 and 313 while connecting shaft 203 is inserted into the coiled middle portion of the elastic member. Preferably, the elastic member is a torsion spring 314.

Figure 4A:
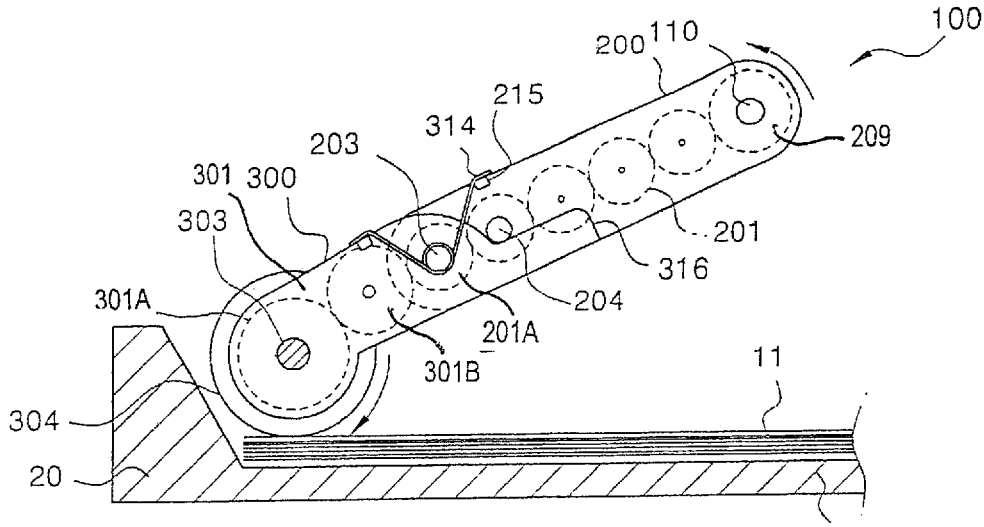
FIGS. 4*a* and 4*b* are side cross-sectional views illustrating an operating state of the paper pickup apparatus.

An operation of the paper pickup apparatus according to the principle of the present invention is explained hereinafter with reference to FIGS. 4*a* and 4*b*. Second pickup housing 300 is located in a first position where third protrusion portion 316 contacts limiting shaft 204 as shown in FIG. 4*a*. When a signal to pick up a print sheet 11 is received from a controller of a printer, motor 112 begins to rotate in response to the signal. Motor 112 rotates driving shaft 110 through reduction gear 111 after a torque of motor 12 is reduced to a predetermined speed and force by reduction gear 111.

When driving shaft 110 rotates, paper pickup apparatus 100 rotates about driving shaft and pivotally moves toward stack of print sheets 11. The pivot movement works uninterruptedly during a rotation of driving shaft 110. In other words, pickup apparatus 110 pivotally moves until pickup roller 304 contacts print sheet 11. The torque is transferred to second transmission gears 301 of second pickup housing 300 through first transmission gears 201 of first pickup housing 200 and finally rotates pickup roller 304 coupled to pickup shaft 303. At this moment, since second pickup housing 300 is elastically supported by torsion spring 314, second picup housing 300 is not likely to rotate about connecting shaft 203 in a direction by a repulsive force opposite to the pivotal movement. Since limiting shaft 204 contacts third protruding portion 316, second pickup housing 300 does not rotate in a counter clockwise direction.

Figure 4B:
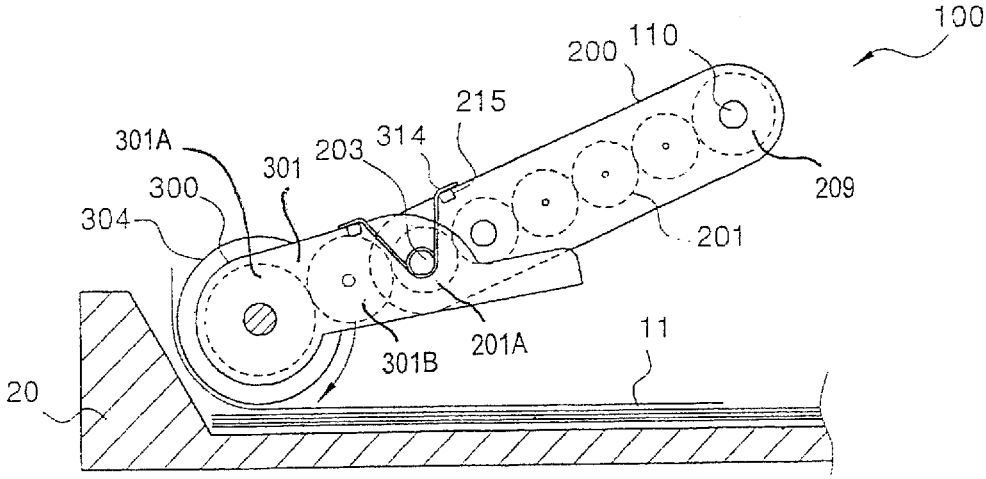

Subsequently, as shown in FIG. 4*b*, when pickup roller 304 contacts the print sheet 11, second pickup housing 300 rotates the counter clockwise direction about connecting shaft 203 and is upwardly lifted to first pickup housing 200 due to continuous pivot force of driving shaft 110. Second pickup housing 300 moves from the first position toward a second position where third protrusion portion 316 does not contacts limiting shaft 204 as shown in FIG. 4*b*. At same time, first and second protruding portions 215 and 313 approach each other while the torsion spring 314 is compressed. The rotational movement of second pickup housing 300 and compression of torsion spring 314 are continued until the pivoting force of driving shaft 110 transmitted to first and second pickup housings 200 and 300 can not overcome elastic force of torsion spring 314. In or words, when one of print sheets 11 is picked up, the pivoting force continuously works on first and second pickup housings 200 and 300 so that the same press-contacting force as applied to the print sheet previously picked up may be applied to the next print sheet 11. The picked up print sheet is transferred to a printing portion along an inclined plane of cassette 20 by a feed roller after picked up from cassette 20, and therefore, a printing operation is performed on the picked up print sheet.

Figure 5A:
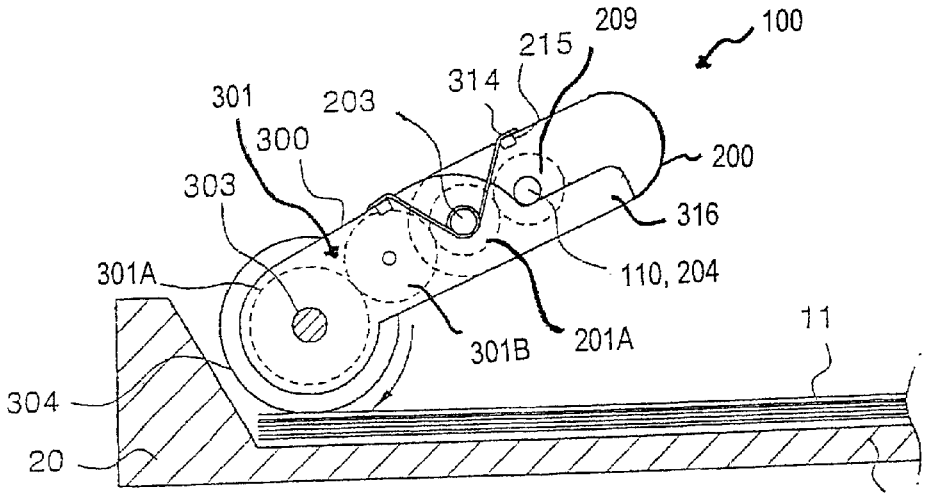
FIGS. 5*a* and 5*b* show another embodiment of the paper pickup apparatus according to the principle of the present invention.
Figure 5B:
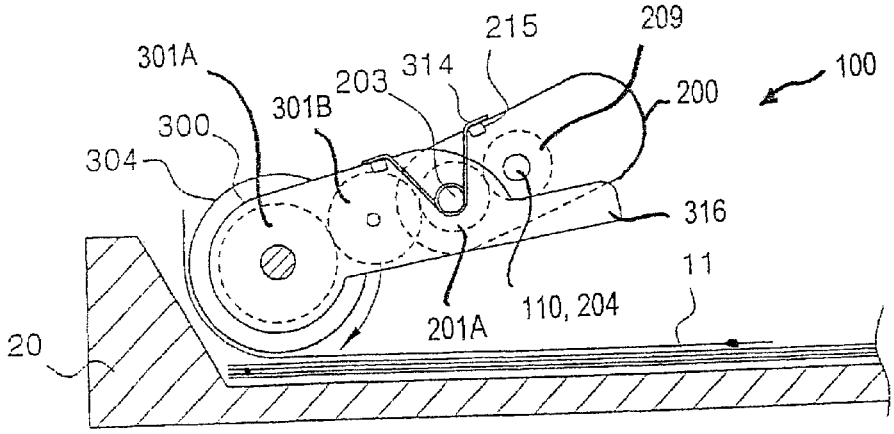

FIGS. 5*a* and 5*b* show another embodiment of first pickup housing 200 of paper picup apparatus 100. While the second, third, and fourth gears 210 are removed from first pickup housing 200, first gear 209 as a driving gear replaces the fifth gear, and driving shaft 110 replaces limiting shaft 204. Therefore, the length of first pickup housing 200 is shortened. The rotational directions of second transmission gears 301 shown in FIGS. 5*a* and 5*b* are same as FIGS. 4*a* and 4*b*.

As described herein before, in the pickup apparatus according to the principle of the present invention, since a repulsive force occurring while pickup roller contacts a stack of a cassette and applying to a first pickup housing can be controlled due to a torsion spring connected between the first and second pickup housing, and due to the rotational movement of the second pickup housing in a state that the pickup roller is maintained to be press-contacted with the printer sheet of the stack, an overload applied to the motor is prevented, and the stability of picking up of the print sheet is improved.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A paper pickup apparatus in a printer having a motor comprising:

a driving shaft rotated by said motor;

a first housing having a first transmission gear disposed within said first housing and coupled to said driving shaft;

a second housing rotatably coupled to said first housing, having a second transmission gear unit disposed within said second housing and coupled to said first transmission gear; and a pickup roller disposed to be coupled to said second transmission gear, rotating by said motor, said first transmission gear, and said second transmission gear.

2. The apparatus of claim 1, further comprising an elastic member for providing an elastic force toward a first direction opposite to a second direction that said second housing rotates about said first housing.

3. The apparatus of claim 2, wherein said second housing rotates about said first housing when said pickup roller contacts a sheet of paper stacked in a cassette disposed in said printer.

4. The apparatus of claim 2, said elastic member being a torsion spring having a first end portion, a second end portion, and a central portion, said first end portion supported by said first housing, said second end portion supported by said second housing, and said central portion inserted by a connection shaft protruding from said second housing.

5. The apparatus of claim 4, said first housing having a first protruding portion located at a location corresponding to said first end portion of said torsion spring, and said second pickup housing having a second protruding portion located at a location corresponding to said second end portion of said torsion spring.

6. The apparatus of claim 5, said first pickup housing further including a limiting shaft inserted into said first transmission gear, and said second pickup housing further including a third protruding portion extending in a longitudinal direction to be limited by said limiting shaft, whereby said second housing is prevented from rotating in said first direction.

7. A paper pickup apparatus in a printer having a motor and a cassette comprising:

a first housing having a driving gear and a connecting gear connected to said driving gear;

a driving shaft rotated by said motor, inserted into said first housing, coupled to said driving gear;

a second housing rotatably coupled to said first housing, having an intermediate gear coupled to said connecting gear and a pickup gear coupled to said intermediate gear;

a pickup roller coupled to said pickup gear, contacting a sheet stacked in said cassette during rotation of said pickup gear; and an elastic member connected between said first housing and said second housing, providing an elastic force toward a first direction opposite to a second direction that said second housing rotates when said pickup roller contacts said sheet.

8. The apparatus of claim 7, further comprising a connection shaft inserted into said connecting gear, inserted into both a first hole formed on said first housing and a second hole formed on said second housing so as to couple said second housing to said first housing and rotate said second housing about an axis passing through said connection shaft.

9. The apparatus of claim 8, wherein the elastic member is a torsion spring having a first end portion, a second end portion, and a central portion, said first end portion connected to said first housing, and said second end portion connected to said second housing.

10. The apparatus of claim 9, said central portion of said torsion spring inserted around said connection shaft.

11. The apparatus of claim 9, wherein said first housing has a first protruding portion located at a location corresponding to said first end portion of said torsion spring, and said second housing has a second protruding portion located at a location corresponding to said second end portion of said torsion spring.

12. The apparatus of claim 7, wherein said driving shaft protrudes from said first housing, and said second housing further includes a third protruding portion extending in a longitudinal direction to contact said driving shaft, whereby said second pickup housing is prevented from rotating in said first direction by the contact between said driving shaft and said third protruding portion.

13. The apparatus of claim 7 further comprising:

a first opening formed on a portion of said first housing, said connecting gear exposed through said first opening; and a second opening formed on a portion of said second housing, said intermediate gear exposed through said second opening and coupled to said connecting gear.

14. The apparatus of claim 7, further comprising a plurality of transmission gears disposed between said driving gear and said connecting gear.

15. The apparatus of claim 7, said second housing rotating in said first direction by said motor, said diving gear, and said connecting gear.

16. The apparatus of claim 15, said second housing rotating in said second direction by contact between said pickup roller and shafts stacked in said cassette after rotating in said first direction.

17. The apparatus of claim 7, said second housing moving between a first position when said motor does not rotate and a second position located below said first position adjacent to said cassette when said motor rotates.

18. The apparatus of claim 17, said second housing rotating from said first position to said second position during rotation of said motor.

19. The apparatus of claim 17 second housing rotating from said second position to said first position when said motor no longer rotates.

20. A process in a printer having a motor and a cassette, comprising:

providing a driving shaft connected to said motor, a first housing having a driving gear coupled to said driving shaft, a second housing rotatably coupled to said first housing, and a pickup roller mounted on said second housing and rotating by said motor;

providing a resilient member disposed between said first housing and said second housing;

providing a protrusion formed on said second housing and a limiting shaft protruded from said first housing and disposed to contact said protrusion;

moving said second housing between a first position and a second position;

rotating said second housing in a first direction from said first position toward said second position and in a second direction from said second position toward said first direction; rotating said second housing in said first direction by said motor;

rotating said second housing in said second direction when said pickup roller contacts a sheet contained in said cassette;

rotating said second housing in said first direction by said resilient member; and limiting said second housing rotating in said first direction.

* * * * *